US008418593B2

(12) United States Patent
Truyman

(10) Patent No.: US 8,418,593 B2
(45) Date of Patent: Apr. 16, 2013

(54) DEFORMABLE REAR DISC FOR MISSILE CONTAINER, INCLUDING A DOWNSTREAM BEARING FRAME

(75) Inventor: Pierre Jacques Truyman, Brie (FR)

(73) Assignee: DCNS, Paris (FR)

( * ) Notice: Subject to any disclaimer, the term of this patent is extended or adjusted under 35 U.S.C. 154(b) by 307 days.

(21) Appl. No.: 12/735,379

(22) PCT Filed: Jan. 8, 2009

(86) PCT No.: PCT/FR2009/050020

§ 371 (c)(1),
(2), (4) Date: Oct. 1, 2010

(87) PCT Pub. No.: WO2009/092938

PCT Pub. Date: Jul. 30, 2009

(65) Prior Publication Data

US 2011/0011251 A1 Jan. 20, 2011

(30) Foreign Application Priority Data

Jan. 11, 2008 (FR) ..... 08 50162

(51) Int. Cl.
*F41F 3/04* (2006.01)

(52) U.S. Cl.
USPC ..... 89/1.8; 89/1.816

(58) Field of Classification Search ..... 89/1.8, 89/1.816, 1.817; 220/260, 281; 137/68.19, 137/68.21
See application file for complete search history.

(56) References Cited

U.S. PATENT DOCUMENTS

| | | | | |
|---|---|---|---|---|
| 4,324,167 | A | 4/1982 | Piesik | |
| 4,498,368 | A * | 2/1985 | Doane | 89/1.817 |
| 4,683,798 | A | 8/1987 | Piesik | |
| 4,686,884 | A | 8/1987 | Piesik | |
| 5,194,688 | A | 3/1993 | Piesik | |
| 8,156,868 | B2 * | 4/2012 | O'Dwyer | 102/438 |

FOREIGN PATENT DOCUMENTS

| | | | |
|---|---|---|---|
| FR | 2 620 808 | | 3/1989 |
| JP | 2001-124494 | | 5/2001 |
| JP | 2001263162 | A * | 9/2001 |
| JP | 2002162193 | A * | 6/2002 |
| JP | 2004-077038 | | 3/2004 |

* cited by examiner

*Primary Examiner* — Gabriel Klein
(74) *Attorney, Agent, or Firm* — Jacobson Holman PLLC

(57) ABSTRACT

The invention relates to an improved deformable downstream disc (56; 156; 256) to be fitted on the bottom of a container (15) for a missile (16) and including a stack of elastic blades (63) clamped between at least an upstream and a downstream thermal protection membrane and sealing membrane (70, 71, 72, 73), and maintained between an upstream bearing frame (61) and a downstream bearing frame (64), characterised in that the downstream bearing frame includes an inner edge (80) having an extension so as to provide the disc with an abutment means defining a position of maximum deformation of the elastic blades.

9 Claims, 2 Drawing Sheets

DEFORMABLE REAR DISC FOR MISSILE CONTAINER, INCLUDING A DOWNSTREAM BEARING FRAME

This is a national stage of PCT/FR09/050020 filed Jan. 8, 2009 and published in French, which has a priority of French no. 0850162 filed Jan. 11, 2008, hereby incorporated by reference.

The present invention relates to a rear disc, also called a downstream disc, fitted to the bottom of a missile container. More particularly, the invention relates to a downstream disc of the deformable type.

A missile launcher suitable for being taken on board a ship is known, which missile launcher comprises a series of cells, each of which is to receive a weapon constituted by a missile located in a container. The upper part of a cell opens in the region of the bridge of the ship and is closed, outside of launch phases, by a door. The lower part of a cell comprises a communication opening which opens into a plenum, which is to receive the gases emitted when a missile is launched. The plenum, which is common to the various cells, is equipped with a gas extraction vent.

A weapon is formed by a missile located inside a container. The upper and lower parts of the container are tightly closed off by a cover provided with an upstream disc and by a bottom provided with a downstream disc, respectively. The inside volume of the container is generally filled with an inert gas at excess pressure relative to the atmosphere (typically 1.5 bar). The lower part of the container is extended by an adapter which is to cooperate with the communication opening between a cell and the plenum. The weapon is inserted into a cell of the launcher from the top, the bottom of the container being then placed in fluid communication with the plenum by means of the adapter.

When the missile is launched, the door of the cell being previously opened, the missile is fired. The propulsion gases then cause the pressure and temperature inside the container to increase considerably, which perforates the upstream disc of the container and opens the downstream disc. Communication of the inside of the container with the plenum via the adapter allows the propulsion gases to be evacuated into the plenum and then extracted via the vent. After firing, the door of the cell is closed again.

When the downstream disc opens, the propulsion gases, which are hot and in which the speed of sound is of the order of 1000 m/s, encounter gases present in the plenum, which are cold and in which the speed of sound is of the order of 300 m/s. A shockwave regime results, with considerable pressure variations in particular at the interface between the masses of hot and cold gas. This phenomenon lasts between 100 and 150 ms, the time for which the cold gases propagate out of the plenum via the extraction vent, and manifests itself in a considerable increase in the temperature and pressure in the plenum during the firing of a missile.

When a missile has been fired and the container that contained it is empty, the firing of a missile contained in an adjacent container causes the production of gas at high pressure and high temperature which may enter the empty container from the plenum and accordingly destroy the door of the corresponding cell. In order to avoid this, it is necessary for the downstream disc of the empty container to close again in order to prevent the shockwave and the propulsion gases present in the plenum from entering the empty container.

To that end there has been proposed, especially in FR 2 620 808, a deformable disc which opens when a missile is launched and closes again thereafter. This deformable disc comprises, superposed axially along a main axis of symmetry, which coincides with the axis of the container, a grid, tearable upstream sealing membranes, a stack of resilient plates, and tearable downstream sealing membranes. The resilient plates are preferably rectangular and are held at their edges between upstream and downstream bearing frames. Each resilient plate is composed of a plurality of triangular petals made of a thin, flexible and resilient metal sheet. In their rest position, the petals are contiguous and accordingly close off the orifice of the disc of the bottom of the container.

When the propulsion gases are ejected from the missile, an excess pressure tears the sealing membranes and deforms the petals by bending them around a rounded inside edge of the lower bearing frame. The edges of the petals move apart and create a passage which established communication between the inside of the container and the plenum via the adaptor. Once the missile has been fired, the pressure inside the container falls. The petals return resiliently to their rest position, in abutment against the grid, and close the orifice of the disc again.

The grid also forms a stop, which has the advantage of preventing the petals from being deformed towards the inside of the container when the plenum is under excess pressure owing to the propulsion gases of an adjacent missile that is in the process of being launched.

These deformable discs with resilient plates suitable for closing containers for receiving a missile have the disadvantage that they do not close properly again after they have been used.

It is an object of the invention, therefore, to propose a deformable disc which provides better closure after it has been used.

To that end, the invention relates to a disc of the deformable type which is to be fitted to the bottom of a missile container and is capable of opening under the thrust of the propulsion gases of a missile contained in the container and of closing again after the missile has been ejected, the disc comprising a grid and a stack of resilient plates which are clamped between at least one heat protection membrane and a sealing membrane, upstream and downstream, and held between an upstream bearing frame and a downstream bearing frame. According to the invention, the downstream bearing frame has an inside edge which is extended in the downstream direction so as to provide the disc with stop means defining a position of maximum deformation of the resilient plates.

According to particular embodiments of the invention, the disc has one or more of the following features, taken in isolation or in all technically possible combinations:

- the inside edge of the downstream frame being profiled, the absolute value of the curvature at any point of the profile of said inside edge being less than a threshold curvature beyond which the material constituting the plates loses its mechanical resilience properties;
- the profile of the inside edge of the downstream bearing frame comprises a convex upstream portion and a straight or concave downstream portion capable of shaping the free end of the resilient plate;
- at least the surface of the inside edge of the downstream bearing frame is made of silicone;
- the thickness of the resilient plates decreases from one plate to another, from upstream to downstream of the stack, the thickness of a plate being chosen so that, in the deformed position, that plate is subjected only to local stresses compatible with the resilience range of the material constituting the plate;

the thickness of a plate, at any point of that plate, is less than a maximum thickness at that point, which is proportional to the radius of curvature of the plate at that point when it is deformed;

the thickness of a plate is constant at any point of said plate and is equal to the smallest of the maximum thicknesses at each point of the plate;

the disc comprises at least one interposed slide means arranged between two successive resilient plates;

each interposed slide means is constituted by a sheet of a heat insulating material;

the material of said sheets is silicone or a mat, preferably a glass fibre mat.

The invention and its advantages will be better understood upon reading the following description, which is given solely by way of example and with reference to the accompanying drawings, in which.

Figure 3:
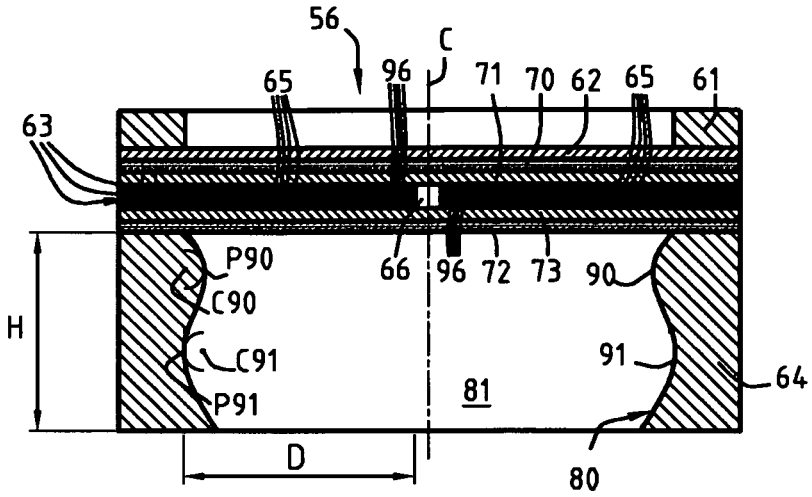
FIG. 3 is a view in axial section of the disc according to the invention fitted to the bottom of a container.
Figure 4:
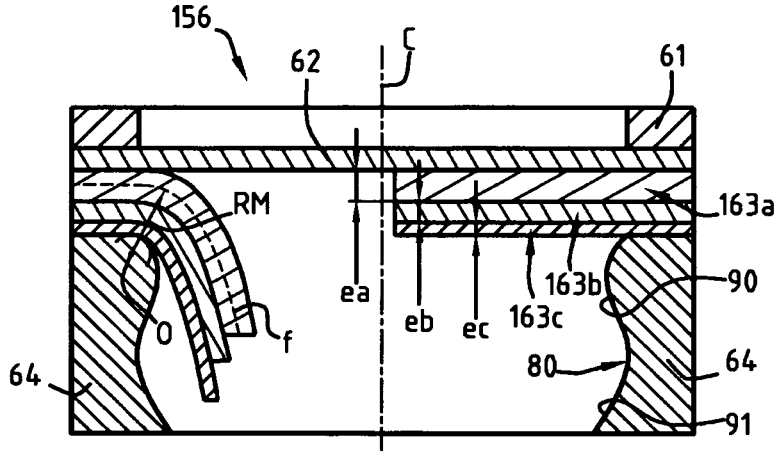
Figure 5:
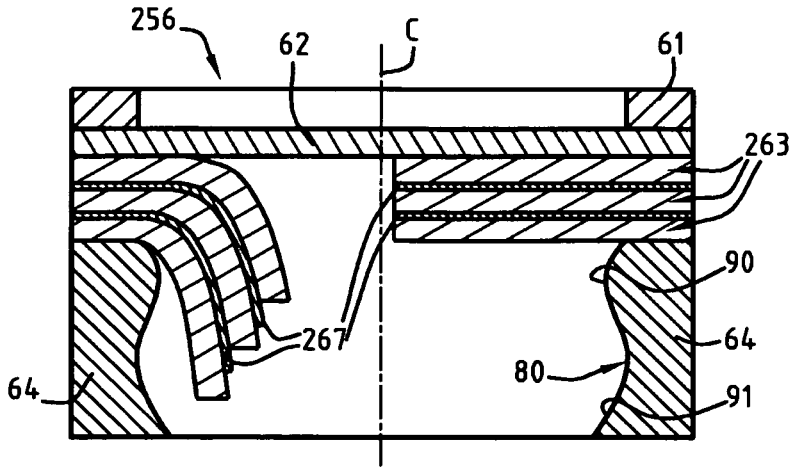

FIG. 4 is an enlarged diagrammatic view of a variant of the disc of FIG. 3 comprising plates of variable thickness, in an open position (left-hand cross-section) and in a closed position (right-hand cross-section); and FIG. 5 is an enlarged diagrammatic view of another variant of the disc of FIG. 3 comprising interposed sheets for the sliding of one petal on another, in an open position (left-hand cross-section) and in a closed position (right-hand cross-section).

Figure 1:
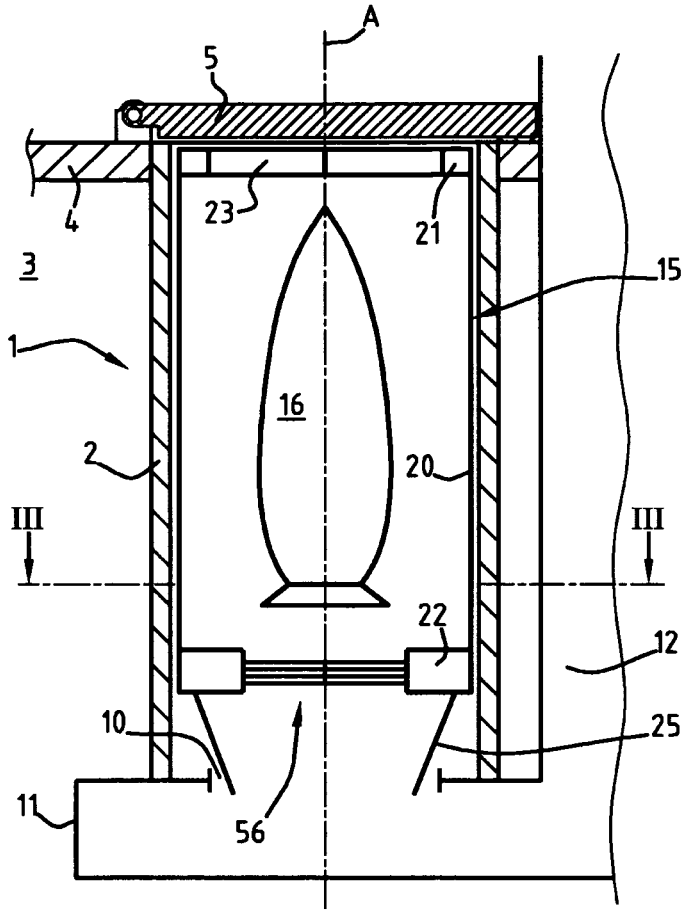
FIG. 1 is a diagrammatic cutaway view of a container inserted into a standard cell.

In FIG. 1, the vertical missile launcher 1 comprises a plurality of cells 2 arranged vertically in the hull 3 of a ship. A cell 2 is a structure composed of a metal lattice which is to receive a weapon formed by a container containing a missile. The upper part of the cell 2 is located in the region of the bridge 4 of the ship and is closed by a door 5, mounted on the bridge 4, which is opened during firing and then closed again. The lower part of the cell 2 has an opening 10 for communication with a plenum 11. The plenum 11 is common to the various cells 2 of the launcher and allows the propulsion gases to be evacuated through a vent 12 which extends vertically between the rows of cells 2. The vent 12 opens at the upper level of the launcher, that is to say in this case in the region of the bridge 4.

A vertical missile launcher comprises cells capable of receiving a weapon constituted by a container 15 in which there is arranged a missile 16 of large diameter. In the inserted position in the cell 2, the axis A of the container 15 coincides with the axis of the cell.

In FIG. 1, the container 15 has a side wall 20, an upper end wall or cover 21, and a lower end wall or bottom 22. The cover 21 is provided with an upstream disc 23. The bottom 22 is provided with a downstream disc 56, which will be described in detail hereinbelow. On the outside, the bottom 22 has an adaptor 25 capable of being inserted into the opening 10 of the plenum 11 during loading of the weapon, so that the gases leaving the container 15 when the missile 16 is launched are guided into the plenum 11.

Figure 2:
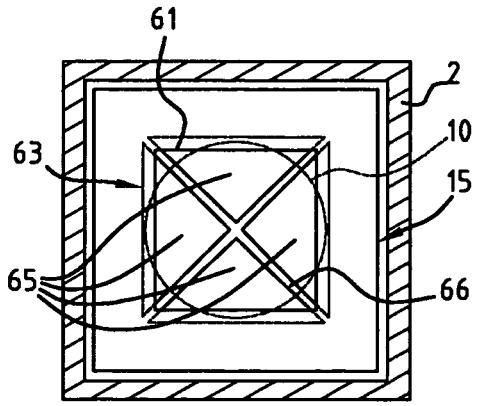
FIG. 2 is a top view of the bottom of the container of FIG. 1.

Referring to FIGS. 2 and 3, the improved downstream disc 56 according to the invention comprises, superposed along an axis of symmetry C, from upstream (the inside of the container) to downstream (the outside of the container), held between an upstream bearing frame 61 and a downstream bearing frame 64, a grid 62; an upstream heat protection membrane 70; an upstream sealing membrane 71, for example made of aluminium; a stack of resilient plates 63; a downstream sealing membrane 73, for example made of aluminium; and a downstream heat protection membrane 72.

Each resilient plate 63 can be of any shape but, for practical reasons, it is preferably rectangular (see FIG. 2), and the stack of resilient plates is held by its peripheral edge between the upstream and downstream rectangular frames 61 and 64. Each resilient plate 63 is composed of four petals of triangular shape 65. Each petal 65 corresponds substantially to a portion of the plate 63 divided along its two diagonals. The edges of two petals 65 facing one another form a space 66 in the form of a cross, the total surface area of which is much smaller than the surface area of the orifice 81 of the disc 56, so that, when the petals 65 are adjacent, the disc 56 can be regarded as closing off the bottom of the container to which it is fitted.

Before the disc 56 is opened, the various intermediate membranes 70, 71, 72 and 73 are in one piece. They can be provided with diagonal lines of lesser resistance corresponding to the subdivision of the plates 63 into petals 65. Accordingly, under the effect of the propulsion gases, the intermediate membranes 70 to 73 tear cleanly along the lines of lesser resistance.

According to the invention, the inside edge 80 of the downstream frame 64 is extended in the downstream direction and has, axially, a suitable profile so as to constitute a stop for the petals.

The upstream frame 64 is rectangular in shape, in the radial plane transverse to the principal axis C, and extends axially along the axis C over a height H greater than a transverse dimension D of a petal 65, corresponding approximately to half the width of the orifice 81 of the disc 56.

Axis C being oriented by the flow of the propulsion, the profile of the edge 80 has a convex upstream portion 90, followed by a concave downstream portion 91. In a variant, the downstream portion 91 may be straight. The upstream and downstream portions 90, 91 are connected to one another in a tangent manner.

The concavity of the upstream portion 90 is so understood that the centre of curvature C90 of the profile of the edge 90 at any point P90 of that profile is located, in projection in a radial plane, outside the central orifice 81. Similarly, the convexity of the downstream portion 91 is so understood that the centre of curvature C91 of the profile of the edge 91 at any point P91 of that profile is located, in projection in a radial plane, inside the central orifice 81. Accordingly, the convexity of the upstream portion 90 is oriented towards the axis C of the disc 56, and the concavity of the downstream portion 91 is oriented towards the axis C of the disc 56.

Advantageously, the edge 80 of the downstream frame 64 is made of a material such as silicone, which is both a heat insulator and has high mechanical strength for supporting the petals.

The operation of the disc 56 when fitted to the bottom of the container 15 of FIG. 1 will now be described, the axis C of the disc then coinciding with the axis A of the container 15. When the missile 16 is launched, the door 5 of the cell 2 is opened. The missile 16 is then fired. The propulsion gases then cause the pressure and temperature inside the container 15 to increase considerably. Under the effect of the pressure, the upstream disc 54 is perforated and the downstream disc 56 opens, which allows the missile to leave and the gases to be evacuated. Opening of the downstream disc takes place by action of the pressure applied to the upper or upstream surface of a plate 63, so that it is deformed and moves away from its rest position, that deformation of the petals being accompanied by tearing of the sealing and heat protection membranes 70 to 73. A petal 65 is deformed around an inside edge 80 of the downstream frame 64. The tearing of the membranes 70-73 and the movement of the various petals 65 of the plates 63 away from one another creates a passage, establishing communication between the inside of the container 15 and the plenum 11 via an adaptor 25. The adapter serves to receive the gases passing through the bottom 22 of the container 15 in order to guide them through the inlet opening 10 of the plenum 11.

The curvature at each point P of the profile of the edge 80 is determined so that the region of the petal 65 that is in abutment at that point P of the profile has a limited and controlled maximum deformation. By forming the profile of the edge 80 so that the absolute value of the curvature remains below a threshold value, it is ensured that the local deformation of the material constituting the petals 65 remains below a threshold deformation beyond which the material acquires permanent deformation. It is thus ensured that each petal 65 retains its resilience and effectively returns to its rest position.

The fact that the downstream portion 91 of the edge 80 is concave, or at the very least straight, has the following advantage. It is possible for the point 96 of the triangular petal 65, which is located close to the combustion flame produced by the missile, to be plasticised. In the position of maximum deformation, the point 96 rests on the concave or straight downstream portion 91, which gives it a shape having a curvature oriented towards the axis C. Accordingly, the plasticised point 96 is bent towards the grid 62, so that it is applied to the grid 62 when the petal returns to its rest position. It is thus ensured that the space 66 between the petals 65 is minimal after use.

Once the missile 16 has been fired, the pressure inside the container 15 falls. Because the petals 65 have retained their mechanical resilience properties owing to the presence of the extended frame 80, they effectively return to the rest position, closing the disc 56 again. The grid 62 forms a stop which ensures that the petals 65 easily return to their rest position, in which they are in a plane transverse to the axis C of the disc and for which the space 66 is as small as possible. The grid 62 also prevents the petals 65 from bending towards the inside of the tube 51 when the adaptor 25 is under excess pressure owing to the propulsion gases of a missile launched from an adjacent tube.

Referring to FIG. 4, which shows an enlarged diagrammatic view for greater clarity, according to an embodiment, the disc 156 further comprises a stack of resilient plates 163*a*, 163*b*, 163*c* of variable thickness ea, eb, ec. More precisely, the resilient plates located upstream of the stack have a greater thickness than do the resilient plates located downstream of the stack. In FIG. 4, the thicknesses ea, eb and ec of the three plates 163*a*, 163*b* and 163*c* shown diagrammatically gradually decrease from upstream to downstream of the stack. The thickness of each plate 163*a*, 163*b* or 163*c* is chosen so that, when the latter is under stress, in abutment against an inside edge 80 of the downstream bearing frame 64, its upstream face, which is facing the combustion flame, undergoes elongation which remains compatible with the resilience range of the metal constituting the plate.

More precisely, the edge 80 of the downstream frame 64 has a rounded portion 90 having a centre of curvature O. The thickness e of the plate 63 at a point is chosen to be less than a maximum thickness em, which is greater, the greater the radius of curvature RM of the neutral axis f at that point of the deformed plate 63 around the rounded portion. Preferably, the thickness of the plate is constant and is chosen to be the smallest of the thicknesses em at any point of the plate. The person skilled in the art knows how to determine suitable thicknesses.

By providing the resilient plates which thicknesses that vary from upstream to downstream along the axis of the disc, the local occurrence of an elongation under stress is avoided, which would cause the material of the plate to lose its resilience.

In another embodiment shown in FIG. 5, in diagrammatic form for greater clarity, an improved deformable downstream disc 256 further comprises a stack of resilient metal plates 263 of variable thickness which are separated from one another by interposed sheets 267 made of a temperature-resistant non-metallic material, suitable for facilitating sliding of the resilient plates on one another.

By providing the disc 256 with interposed slide means 267, the formation of welds between two successive plates 263 is avoided, and the sliding of the plates on one another is improved. Accordingly, the closing movement of the disc 256 is facilitated.

Secondly, by interposing a sheet 267 of a non-metallic material at the interface between two adjacent metal plates 263, the conduction of heat from one plate to another is limited. Accordingly, even if the temperature of the propulsion gases causes an upstream plate to be plasticised, the heat of that plate is only partially transmitted to the following downstream plate which, consequently, becomes heated to a lesser degree and better retains its resilience. As a result, the downstream plates of the stack retain their resilient properties after the disc 256 has opened and contribute towards the closing of the disc 256 by pushing the upstream plates, which may have been plasticised, towards the grid 62. Closing off of the disc 256 is thus improved.

The interposed sheet 267 is preferably made of a heat insulating material such as silicone or of a mat, for example of glass fibres.

The embodiments which have just been described each improve the conditions of resilient return of the resilient plates in order to ensure that the disc closes again. The person skilled in the art will understand that these different means are complementary and can be combined as required.

It will be noted that it is sufficient for the disc to close until sufficient partial closure is obtained. Beyond that threshold closure, the loss of pressure of the shockwave as it passes through the partially open disc is such that it generates a force on the plates that is sufficient to flatten them against the grid and thus close the disc completely.

The invention claimed is:

1. A deformable disc (56; 156; 256) which is to be fitted to the bottom of a missile container (15) and is capable of opening under the thrust of the propulsion gases of a missile (16) contained in the container and of closing again after the missile has been ejected, the disc comprising a grid (62) and a stack of resilient plates (63; 163; 263) which are clamped between at least one heat protection membrane and a sealing membrane, upstream and downstream (70, 71, 72, 73), and held between an upstream bearing frame (61) and a downstream bearing frame (64), characterised in that the downstream bearing frame has an inside edge (80) which is extended in the downstream direction and is profiled so that it comprises a convex upstream portion (90) and a straight or concave downstream portion (91) capable of shaping a free end (96) of each resilient plate (63), so as to provide the disc with stop means defining a position of maximum deformation of the resilient plates, ensuring that the material constituting the plates (63; 163; 263) retains its mechanical resilience properties.

2. Disc according to claim 1, characterised in that the absolute value of the curvature at any point of the profile of said inside edge is less than a threshold curvature beyond which the material constituting the plates (63; 163; 263) loses its mechanical resilience properties.

3. Disc according to claim 1, characterised in that at least the surface of the inside edge (80) of the downstream bearing frame (64) is made of silicone.

4. Disc (156) according to claim 1, characterised in that the thickness (ea, eb, ec) of the resilient plates (163*a*, 163*b*, 163*c*) decreases from one plate to another, from upstream to downstream of the stack, the thickness of a plate being chosen so that, in the deformed position, that plate is subjected only to local stresses compatible with the resilience range of the material constituting the plate.

5. Disc (156) according to claim 4, characterised in that the thickness (ea, eb, ec) of a plate (163*a*, 163*b*, 163*c*), at any point of that plate, is less than a maximum thickness at that point, which is proportional to the radius of curvature of the plate at that point when it is deformed.

6. Disc (156) according to claim 5, characterised in that the thickness (ea, eb, ec) of a plate is constant at any point of said plate (163*a*, 163*b*, 163*c*) and is equal to the smallest of the maximum thicknesses (em) at each point of the plate.

7. Disc (256) according to claim 1, characterised in that it comprises at least one interposed slide means (267) arranged between two successive resilient plates (263).

8. Disc (256) according to claim 7, characterised in that each interposed slide means is constituted by a sheet (267) of a heat insulating material.

9. Disc (256) according to claim 8, characterised in that the material of said sheets (267) is silicone or a mat, preferably a glass fibre mat.

* * * * *